US007100592B1

(12) United States Patent
Yang

(10) Patent No.: US 7,100,592 B1
(45) Date of Patent: Sep. 5, 2006

(54) TOY GUN HAVING DUAL ACTUATING MANNERS

(75) Inventor: Chung-Kuan Yang, Sanchong (TW)

(73) Assignee: Unicorn Hobby Corp., Sanchong (TW)

( * ) Notice: Subject to any disclaimer, the term of this patent is extended or adjusted under 35 U.S.C. 154(b) by 0 days.

(21) Appl. No.: 11/286,490

(22) Filed: Nov. 23, 2005

(30) Foreign Application Priority Data

Jun. 24, 2005 (TW) ..... 94121182 A

(51) Int. Cl.
*F41B 11/00* (2006.01)

(52) U.S. Cl. ..... 124/67
(58) Field of Classification Search ..... 42/54; 124/63–68
See application file for complete search history.

(56) References Cited

U.S. PATENT DOCUMENTS 6,564,788 B1 * 5/2003 Hu ..... 124/66

* cited by examiner

*Primary Examiner*—Stephen M. Johnson
*Assistant Examiner*—Gabriel J. Klein
(74) *Attorney, Agent, or Firm*—Alan D. Kamrath; Nikolai & Mersereau, P.A.

(57) ABSTRACT

A toy gun includes a driven lever, a driven member, a pivot member, a push block, a drive mechanism, a triggering device, and a housing. Thus, the toy gun can shoot the plastic cartridges successively in an automatically controlled manner by the motor and the power switch and can also shoot the plastic cartridges individually in a manual manner by pulling the pull member and pressing the trigger, thereby enhancing the versatility of the toy gun, and thereby increasing the playing amusement of the toy gun.

20 Claims, 17 Drawing Sheets

TOY GUN HAVING DUAL ACTUATING MANNERS

BACKGROUND OF THE INVENTION

1. Field of the Invention

The present invention relates to a toy gun and, more particularly, to a toy gun having dual actuating manners.

2. Description of the Related Art

A conventional toy gun comprises a housing, a piston, a spring, a magazine, and a trigger. The piston is pulled to compress the spring in the housing. When the trigger is pressed, the piston is released to release the spring so as to eject the cartridge contained in the magazine outward by the restoring force of the spring. However, the toy gun manually controlled by the user only shoots the cartridge once at a time, and cannot shoot the cartridge successively, thereby decreasing the amusement effect of the toy gun.

A conventional motorized toy gun comprises a motor which drives a drive mechanism to pull the piston to compress the spring in the housing. Thus, the motorized toy gun can shoot the cartridge successively, thereby increasing the amusement effect of the toy gun. However, the electric power of the motor is supplied by a battery, so that the motorized toy gun is inoperative when the electric power from the battery is exhausted, thereby causing inconvenience to the user.

SUMMARY OF THE INVENTION

In accordance with the present invention, there is provided a toy gun, comprising a housing, a driven lever driven by a trigger to slide transversely, and having an end provided with a hook portion and a side pin located beside the hook portion, a drive mechanism including a motor, a driven member having a first end provided with a hook portion hooked on the hook portion of the driven lever and a second end formed with a mounting hole mounted on a push button of a power switch so as to control an electric connection of the motor which drives the drive mechanism to drive a piston to move in a sleeve reciprocatingly, to compress and pressurize air contained in the sleeve to form a successive shooting controlled by the motor and the power switch, a push block mounted on a mediate portion of the driven member in a perpendicular manner and having a side provided with a push knob which is protruded from the housing and movable to drive the push block to push the driven member to detach the hook portion of the driven member from the hook portion of the driven lever to interrupt the electric connection of the motor to stop the successive shooting controlled by the motor and the power switch, and a pivot member pivotally mounted in the housing and having a first end having a first side provided with a recessed catch ramp rested on the side pin of the driven lever and a second end having a second side provided with an oblique push portion engaged with a rack provided on a periphery of the piston.

In the preferred embodiment of the present invention, the driven lever is driven manually to move the side pin which pushes the catch ramp of the pivot member to pivot the pivot member which moves the push portion to disengage from the rack of the piston, thereby detaching the piston from the pivot member, such that the piston is pressed into the sleeve by an elastic force of a piston spring to compress and pressurize the air contained in the sleeve to form an individual shooting controlled in a manual work.

The primary objective of the present invention is to provide a toy gun having dual actuating manners.

Another objective of the present invention is to provide a toy gun that is actuated in a manual manner or by a motor.

A further objective of the present invention is to provide a toy gun that can shoot the plastic cartridges successively in an automatically controlled manner by the motor and the power switch and can shoot the plastic cartridges individually in a manual manner by pulling the pull member and pressing the trigger, thereby enhancing the versatility of the toy gun, and thereby increasing the playing amusement of the toy gun.

Further benefits and advantages of the present invention will become apparent after a careful reading of the detailed description with appropriate reference to the accompanying drawings.

DETAILED DESCRIPTION OF THE INVENTION

Figure 1:
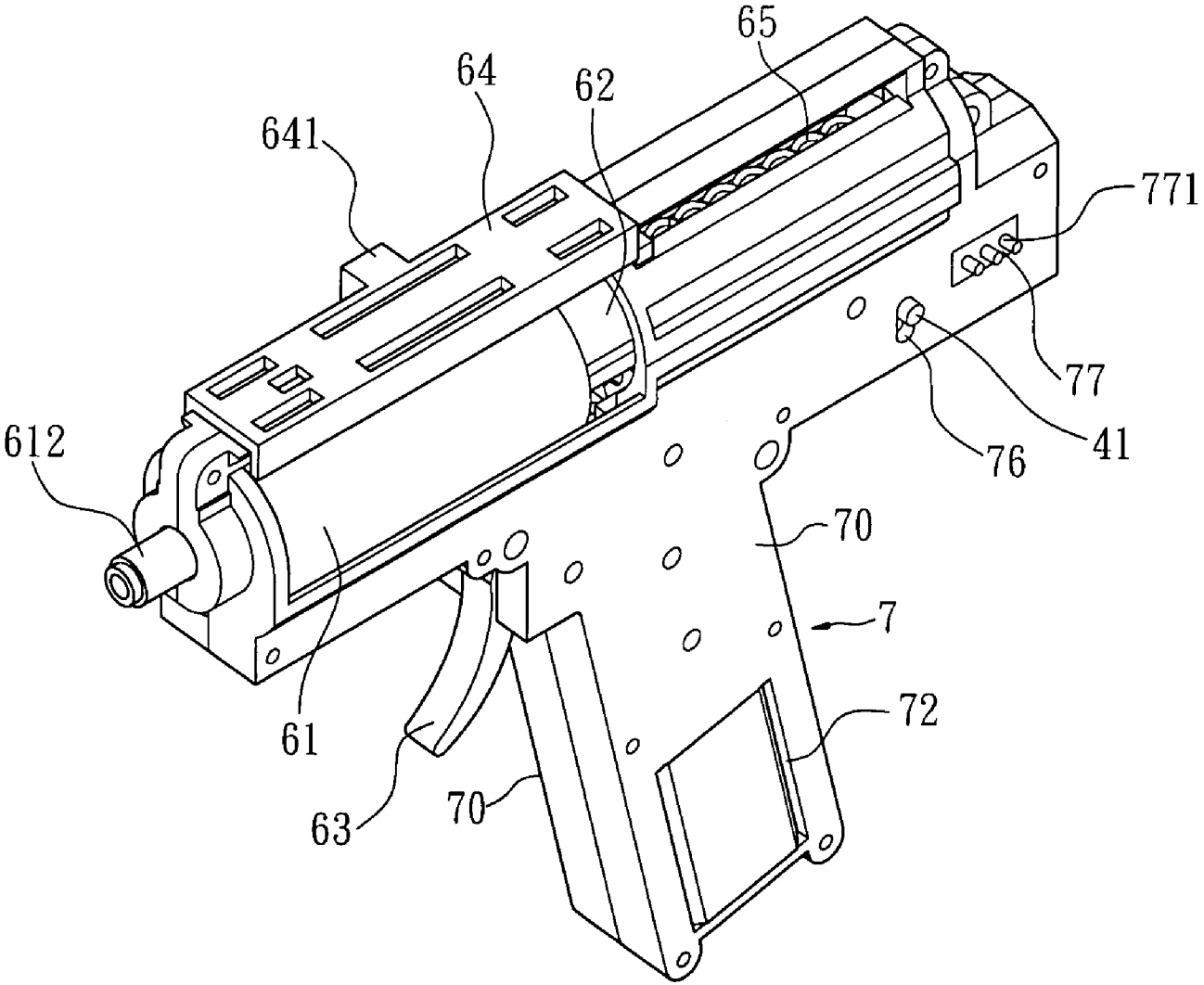
FIG. 1 is a perspective view of a toy gun in accordance with the preferred embodiment of the present invention.
Figure 2:
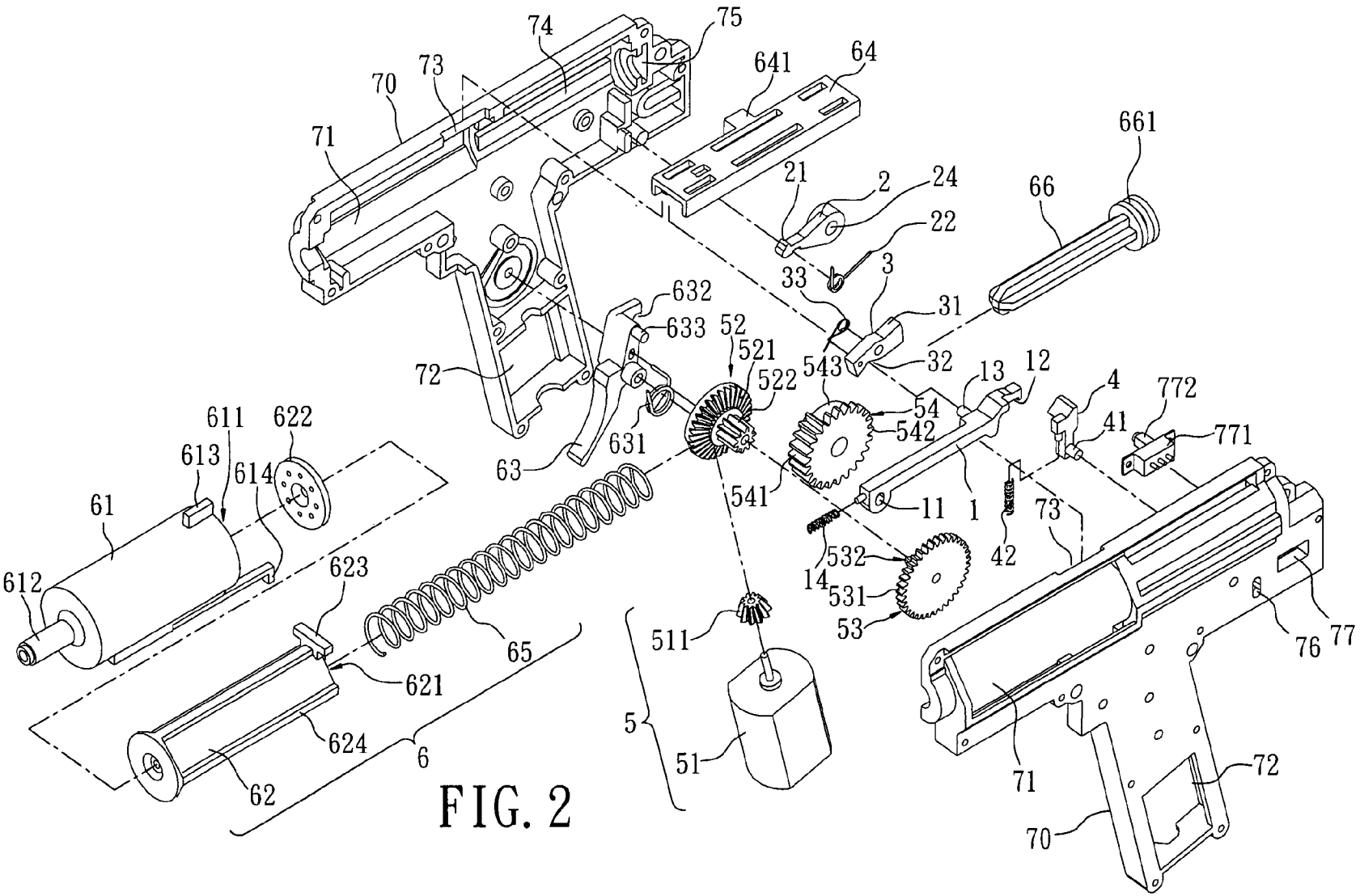
FIG. 2 is an exploded perspective view of the toy gun as shown in FIG. 1.

Referring to the drawings and initially to FIGS. 1–5, a toy gun in accordance with the preferred embodiment of the present invention comprises a driven lever 1, a driven member 2, a pivot member 3, a push block 4, a drive mechanism 5, a triggering device 6, and a housing 7.

The housing 7 includes two shells 70 combined with each other. The housing 7 is substantially T-shaped and has an upper portion formed with a hollow portion 71, two opposite side guide channels 74, a guide slot 73 located between the hollow portion 71 and the side guide channels 74 and a positioning recess 75 located at distal ends of the side guide channels 74. The housing 7 has a lower portion formed with a motor chamber 72. The upper portion of one of the two shells 70 of the housing 7 is formed with a horizontally extending power switch chamber 77 and a vertically extending control slot 76. A power switch 771 is mounted in the power switch chamber 77 of the housing 7.

The drive mechanism 5 includes a motor 51, a first composite gear 52, a second composite gear 53, and a third composite gear 54.

The motor 51 of the drive mechanism 5 is mounted in the motor chamber 72 of the housing 7 and has a bevel gear 511 to output the power of the motor 51. The motor 51 of the drive mechanism 5 is electrically connected to the power switch 771 of the housing 7.

The first composite gear 52 of the drive mechanism 5 includes a bevel gear 521 and a gear 522. The bevel gear 521 of the first composite gear 52 meshes with the bevel gear 511 of the motor 51.

The second composite gear 53 of the drive mechanism 5 includes a first gear 531 meshing with the gear 522 of the first composite gear 52 and a second gear 532 co-axial with and smaller than the first gear 531.

The third composite gear 54 of the drive mechanism 5 has a first side formed with a first gear 542 meshing with the second gear 532 of the second composite gear 53 and a second side having a periphery formed with a partially extending second gear 541 and a partially extending breach 543. The third composite gear 54 of the drive mechanism 5 has a side pin 544 protruding from the second side of the third composite gear 54.

The triggering device 6 includes a sleeve 61, a piston 62, a trigger 63, a pull member 64, a piston spring 65, and a plug 66.

The sleeve 61 of the triggering device 6 is mounted in the hollow portion 71 of the housing 7 and has a first end formed with a receiving space 611 having an opening and a second end provided with an air nozzle 612 connected to the receiving space 611. The first end of the sleeve 61 has a periphery provided with a lug 613 extended into the guide slot 73 of the housing 7 and a substantially L-shaped hook portion 614 located opposite to the lug 613.

The piston 62 of the triggering device 6 has a first end combined with a piston washer 622 and extended into the receiving space 611 of the sleeve 61 and a second end formed with a receiving space 621 having an opening. The first end of the piston 62 has a periphery provided with a catch 623. The piston 62 of the triggering device 6 has a periphery provided with an axially extending rack 625 meshing with the second gear 541 of the third composite gear 54 and two opposite axially extending side rails 624 slidable in the side guide channels 74 of the housing 7.

The piston spring 65 of the triggering device 6 is mounted in the receiving space 621 of the piston 62.

The plug 66 of the triggering device 6 is extended through the piston spring 65 and extended into the receiving space 621 of the piston 62. The plug 66 of the triggering device 6 has a distal end formed with an annular flange 661 mounted in the positioning recess 75 of the housing 7. The piston spring 65 is biased between the piston 62 and the annular flange 661 of the plug 66.

The trigger 63 of the triggering device 6 is pivotally mounted in the housing 7 and combined with a restoring spring 631 to maintain an elastic pivoting effect. The trigger 63 of the triggering device 6 has an end portion provided with a hook portion 632 extended into a movement path of the side pin 544 of the third composite gear 54 and a side pin 633 located beside the hook portion 632.

The pull member 64 of the triggering device 6 is mounted on a top of the housing 7 and has an end portion rested on the catch 623 of the piston 62. The pull member 64 of the triggering device 6 has a side provided with a pull bar 641 to facilitate a user pulling the pull member 64.

The driven lever 1 has a first end formed with an insertion hole 11 to allow insertion of the side pin 633 of the trigger 63 and a second end provided with a hook portion 12 and a side pin 13 located beside the hook portion 12. A restoring spring 14 is biased between the first end of the driven lever 1 and the housing 7 so that the driven lever 1 is slidable in the housing 7 elastically.

The driven member 2 has a first end provided with a hook portion 21 hooked on the hook portion 12 of the driven lever 1 and a second end formed with a mounting hole 24 mounted on a push button 772 of the power switch 771 so as to control an electric connection of the motor 51. The driven member 2 is combined with a restoring spring 22 to maintain a restoring effect.

The pivot member 3 is pivotally mounted in the housing 7 and combined with a restoring spring 33 to maintain an elastic pivoting effect. The pivot member 3 has a first end having a first side provided with a recessed catch ramp 32 rested on the side pin 13 of the driven lever 1 and a second end having a second side provided with an oblique push portion 31.

The push block 4 is mounted on a mediate portion of the driven member 2 in a perpendicular manner. The push block 4 has a side provided with a push knob 41 extended through and protruded from the control slot 76 of the housing 7. A restoring spring 42 is biased between the push block 4 and the housing 7 so that the push block 4 is slidable in the housing 7 elastically.

Figure 6:
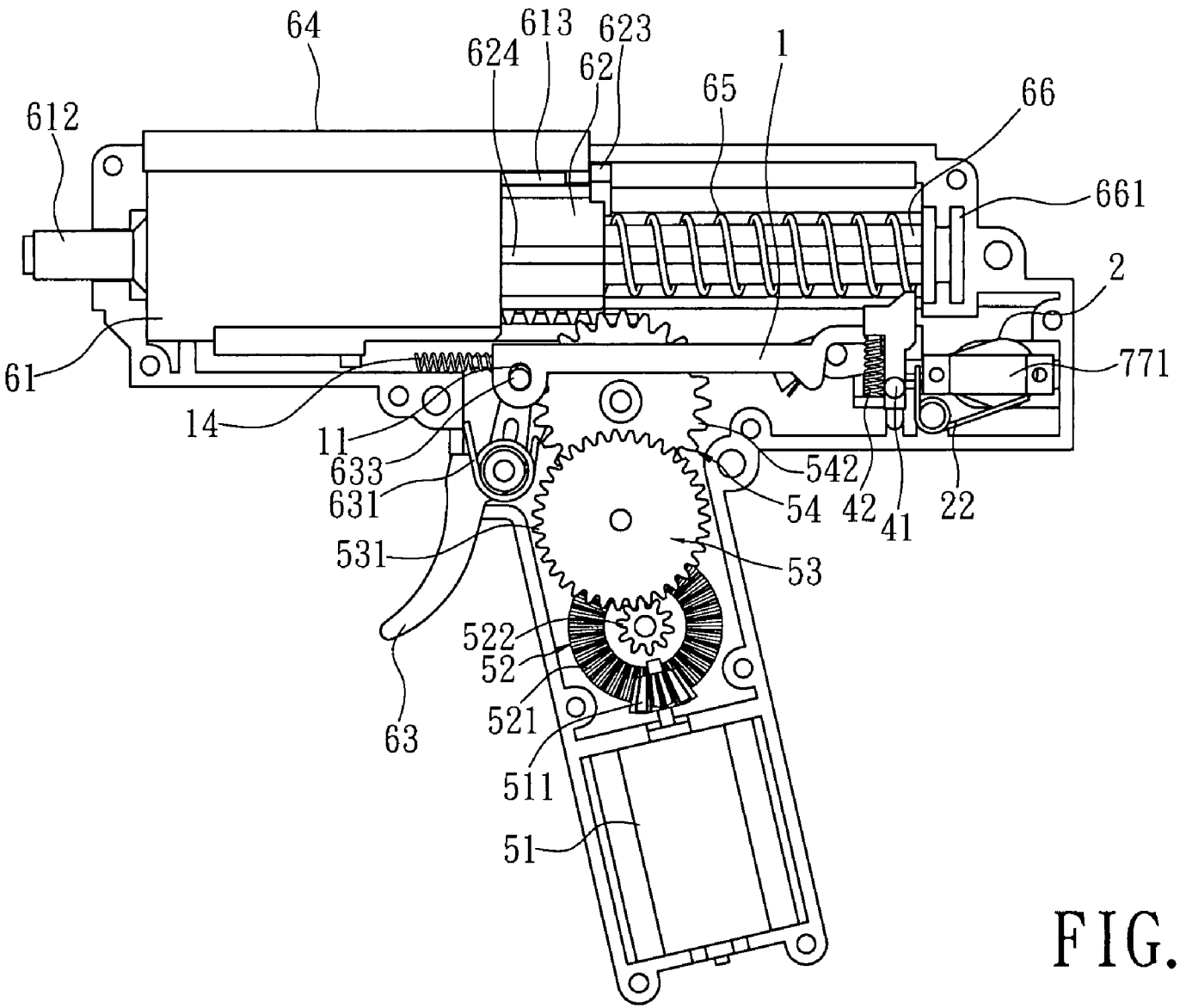
FIG. 6 is a side plan cross-sectional view of the toy gun as shown in FIG. 1.

As shown in FIG. 6, the toy gun is electrically controlled to shoot individually or successively. FIGS. 7–11 show the successive shooting of the toy gun. FIG. 12 shows ending of the successive shooting of the toy gun.

Figure 7:
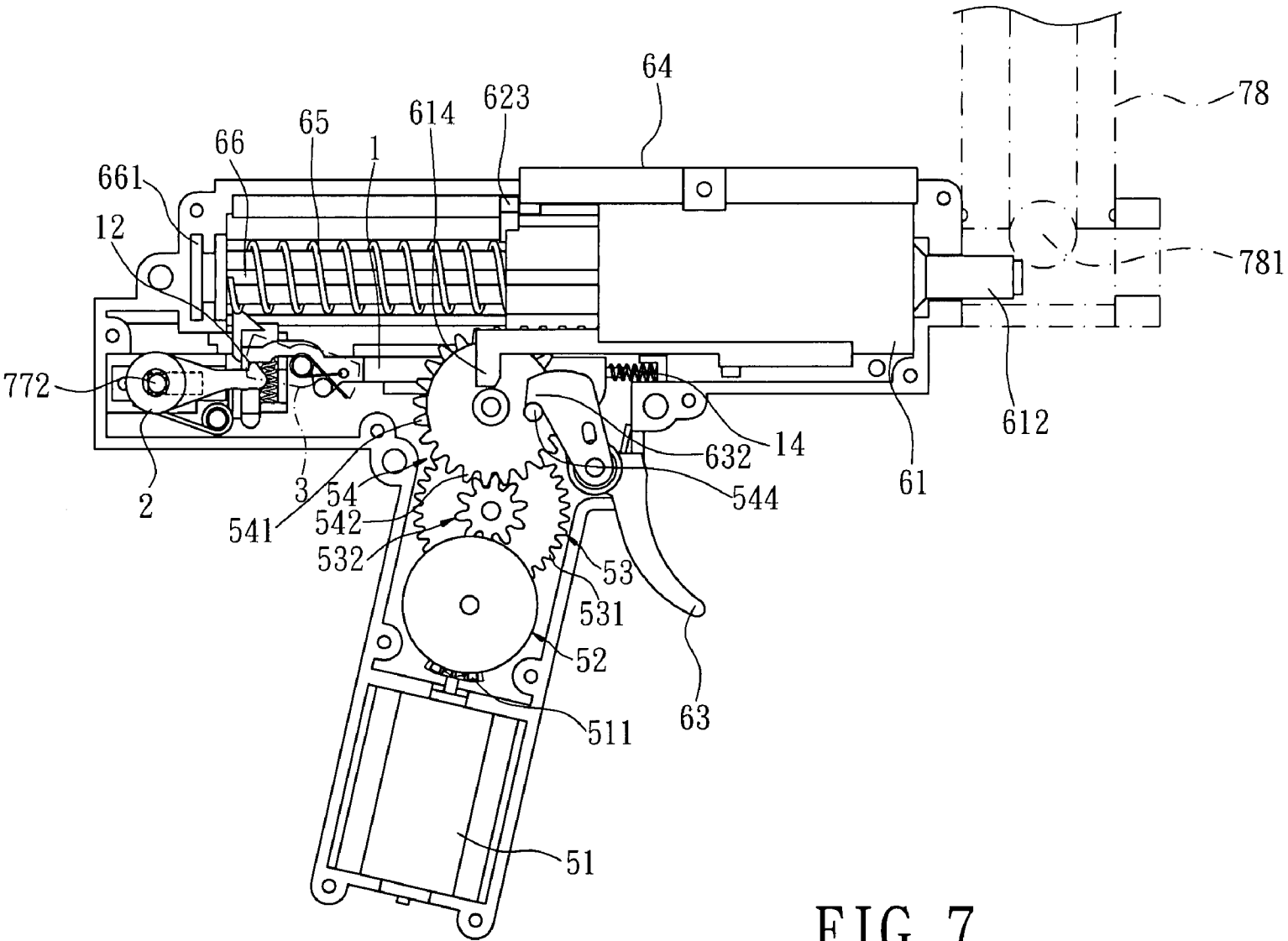
FIG. 7 is a side plan cross-sectional view of the toy gun as shown in FIG. 1.

In operation, referring to FIG. 6 with reference to FIGS. 1–5, the push knob 41 of the push block 4 is pushed upward in the control slot 76 of the housing 7 to detach the push block 4 from the driven member 2. At this time, the hook portion 21 of the driven member 2 is hooked on the hook portion 12 of the driven lever 1. In addition, the hook portion 632 of the trigger 63 is hooked on the side pin 544 of the third composite gear 54 at the normal state. As shown in FIG. 7, the push button 772 of the power switch 771 is disposed at a shut state.

When the trigger 63 is pressed, the hook portion 632 of the trigger 63 is detached from the side pin 544 of the third composite gear 54. At this time, the side pin 633 of the trigger 63 is inserted into the insertion hole 11 of the driven lever 1, the hook portion 21 of the driven member 2 is hooked on the hook portion 12 of the driven lever 1, and the push button 772 of the power switch 771 is mounted in the mounting hole 24 of the driven member 2, so that when the trigger 63 is pressed, the driven lever 1 is driven to move the driven member 2 which pulls the push button 772 of the power switch 771 connect the motor 51 of the drive mechanism 5 to a power supply (not shown).

Figure 8:
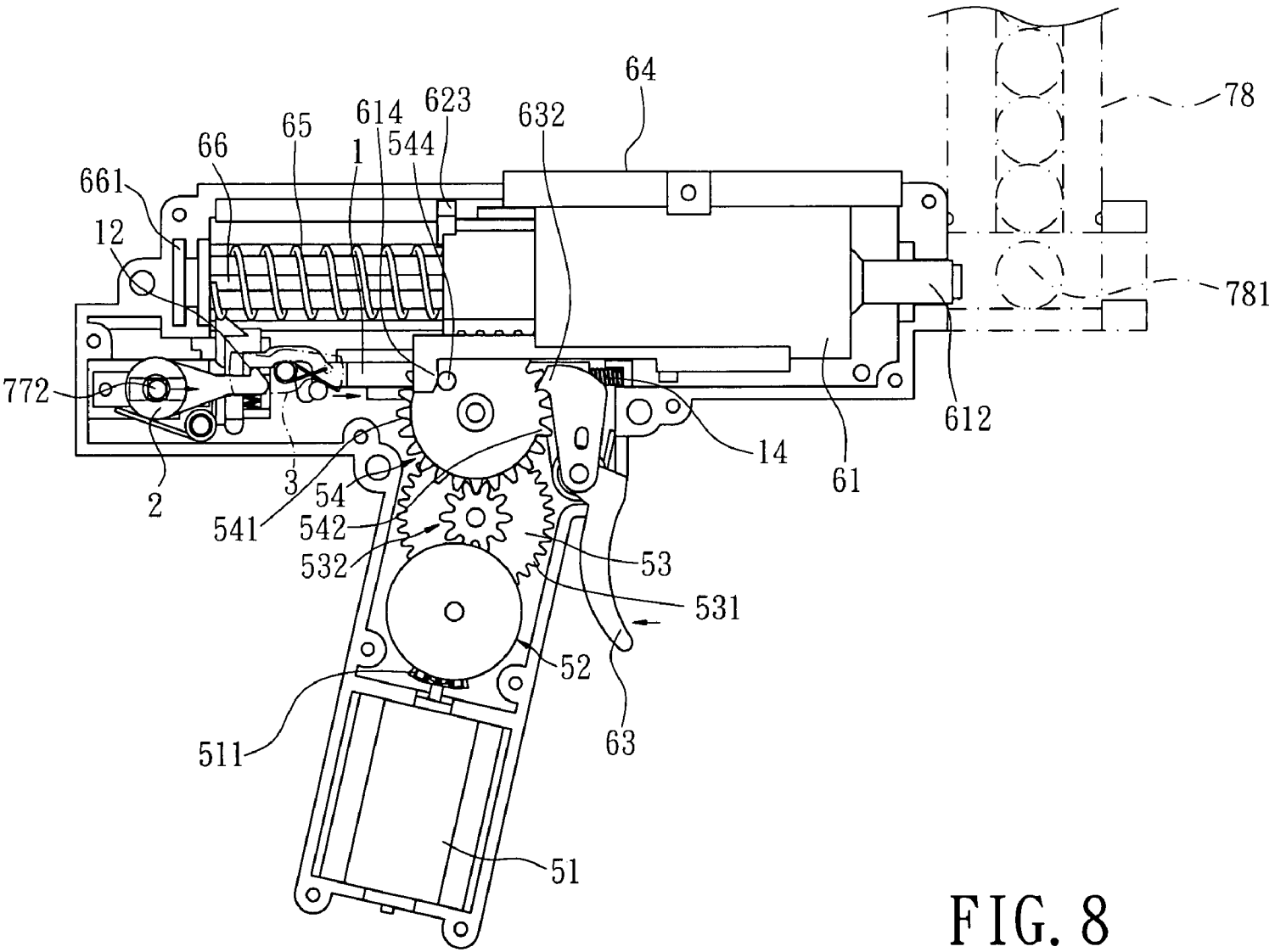
FIG. 8 is a schematic operational view of the toy gun as shown in FIG. 7.

Then, the motor 51 drives the first composite gear 52 which drives the second composite gear 53 which drives the third composite gear 54 which drives the side pin 544 to push the hook portion 614 of the sleeve 61 to retract the air nozzle 612 of the sleeve 61 into the hollow portion 71 of the housing 7, so that a plastic cartridge 781 contained in a magazine 78 falls down to a position in front of the air nozzle 612 of the sleeve 61 as shown in FIG. 8.

Figure 9:
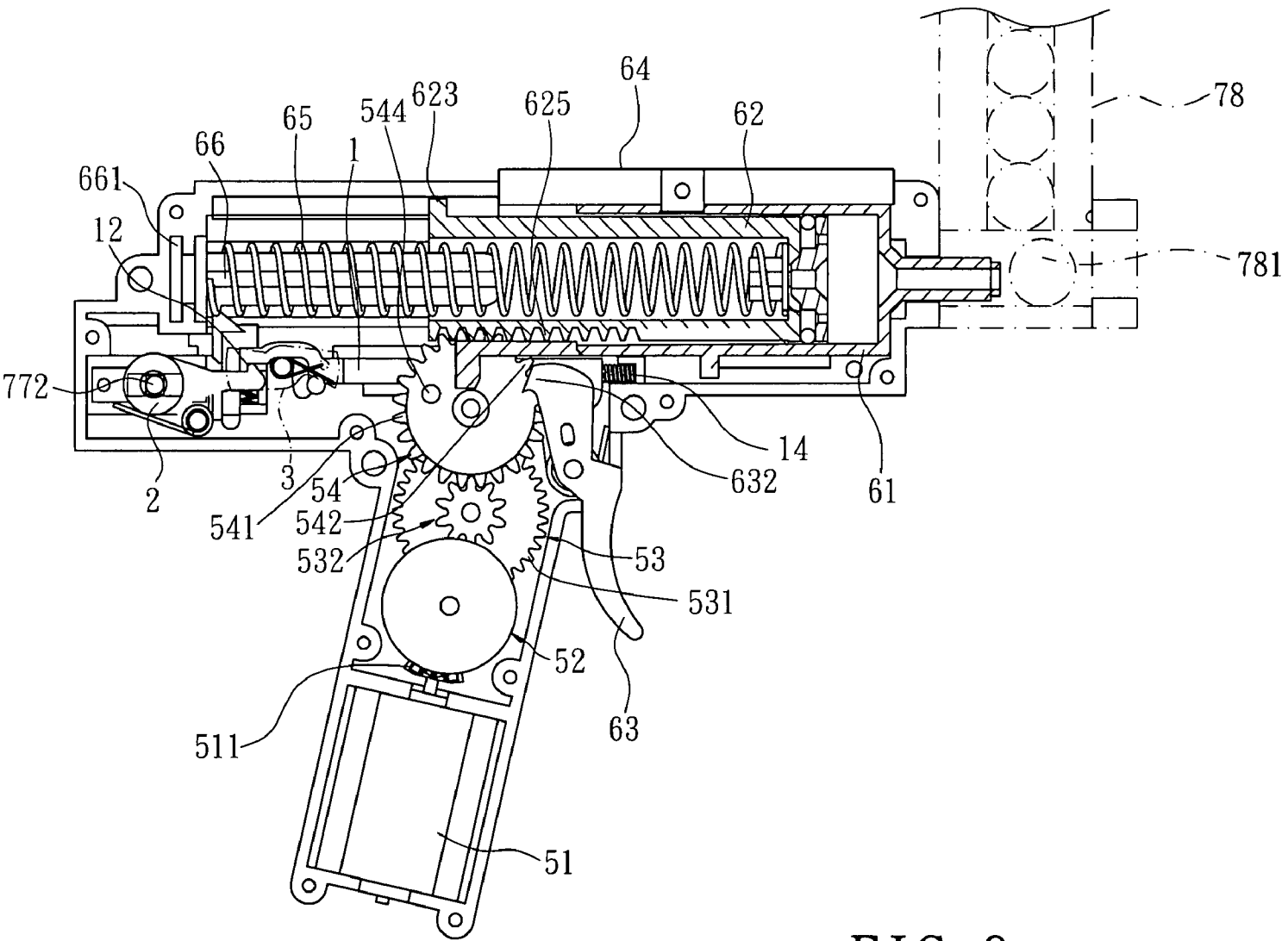
FIG. 9 is a schematic operational view of the toy gun as shown in FIG. 8.
Figure 10:
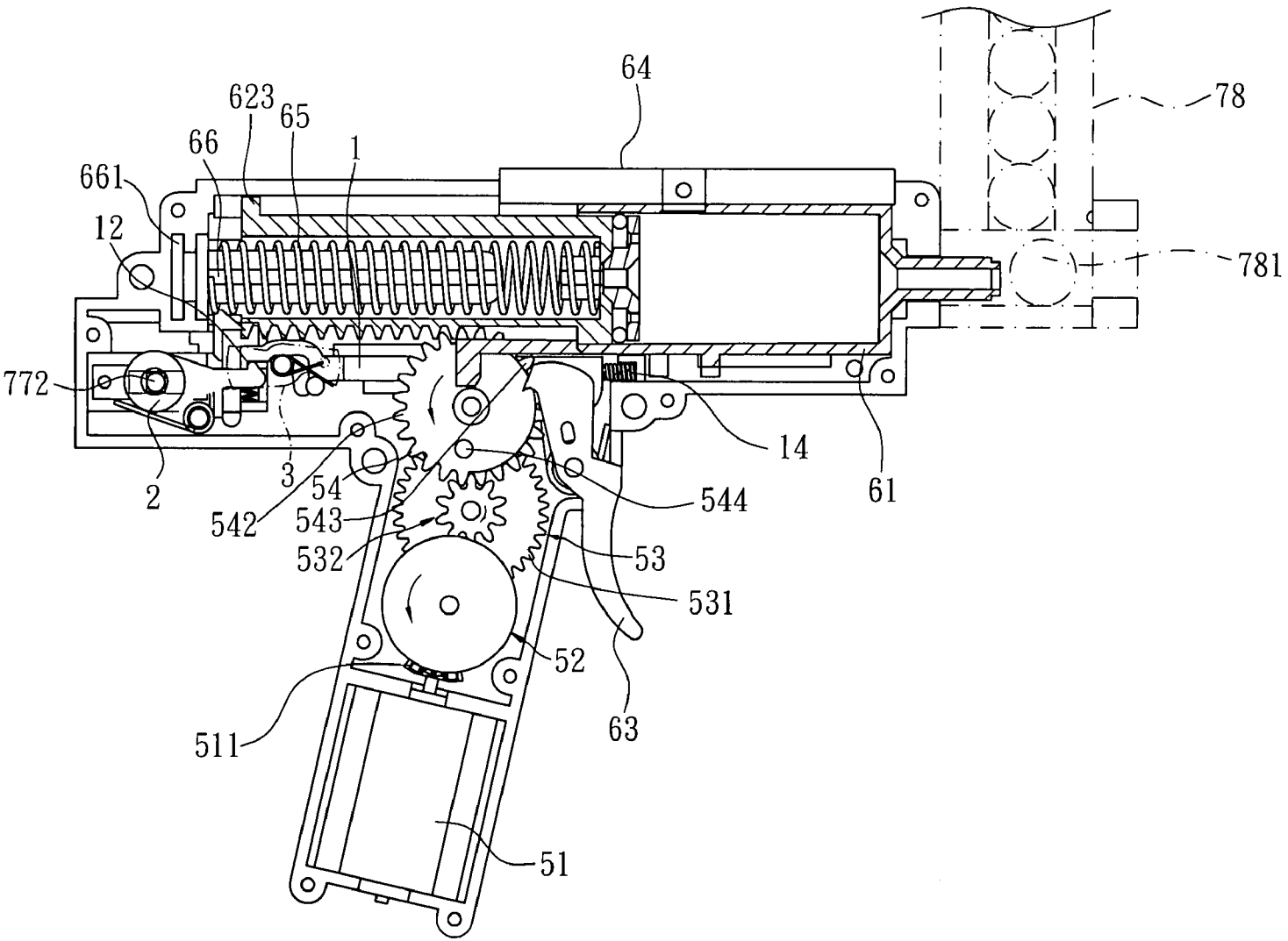
FIG. 10 is a schematic operational view of the toy gun as shown in FIG. 9.

Then, the second gear 541 of the third composite gear 54 meshes with the rack 625 of the piston 62, so that the piston 62 is moved by rotation of the third composite gear 54 to compress the piston spring 65 successively as shown in FIGS. 9 and 10 until the second gear 541 of the third composite gear 54 detaches from the rack 625 of the piston 62.

When the second gear 541 of the third composite gear 54 detaches from the rack 625 of the piston 62, the breach 543 of the third composite gear 54 aligns with the rack 625 of the piston 62, thereby detaching the piston 62 from the third composite gear 54, so that the piston 62 is rapidly pressed into the receiving space 611 of the sleeve 61 by the restoring force of the piston spring 65 to compress and pressurize the air contained in the receiving space 611 of the sleeve 61.

Figure 11:
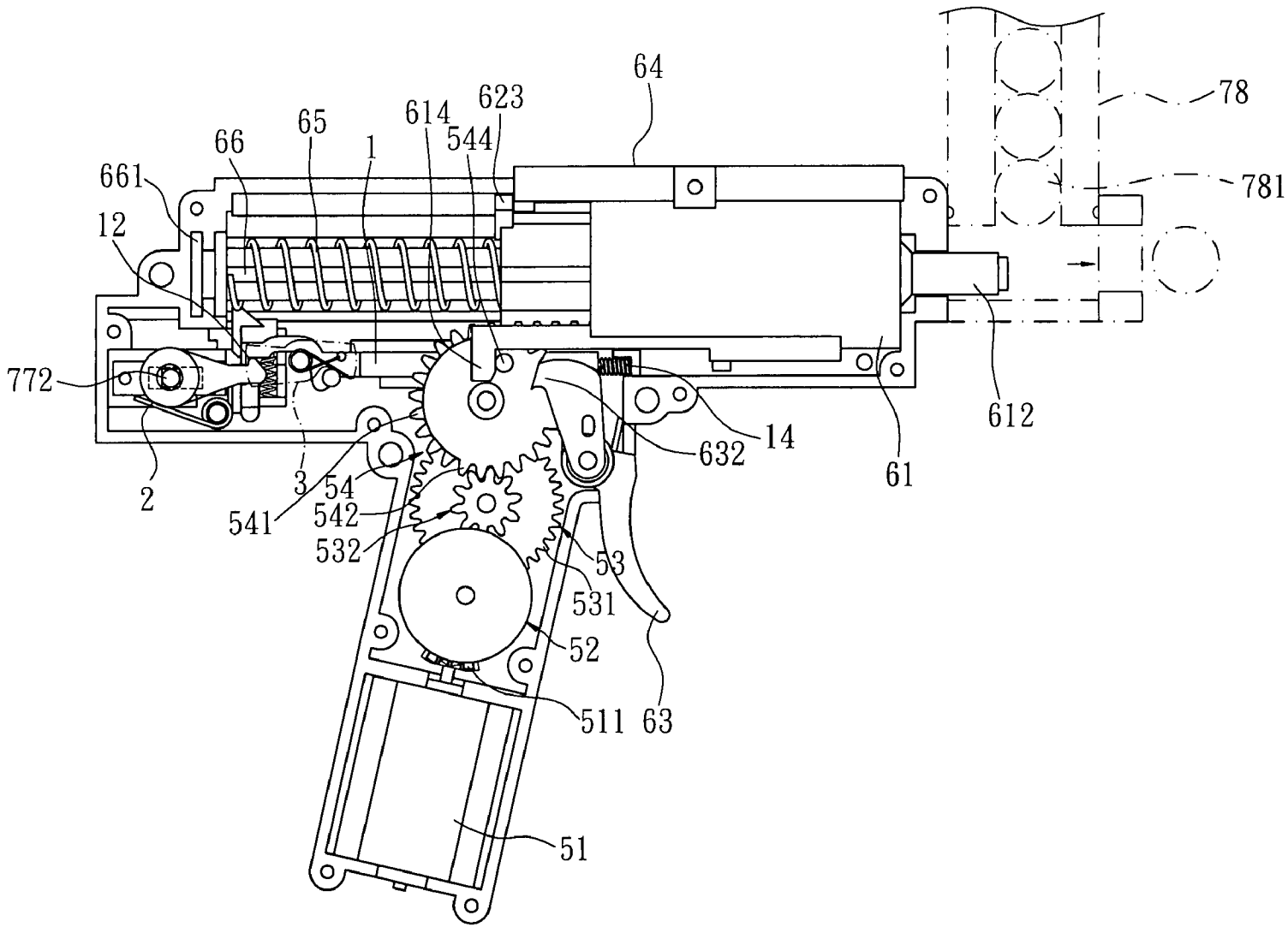
FIG. 11 is a schematic operational view of the toy gun as shown in FIG. 10.
Figure 12:
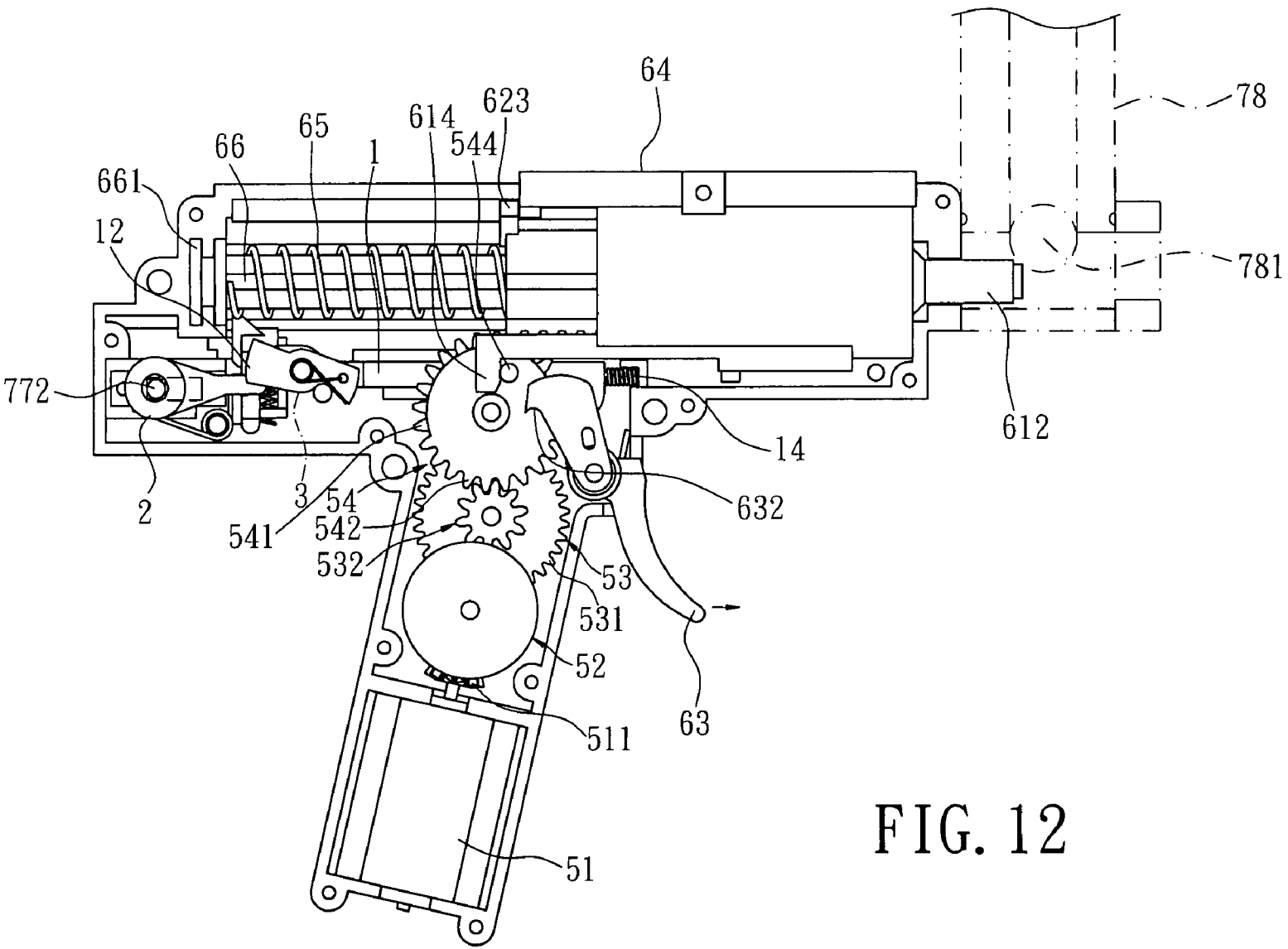
FIG. 12 is a schematic operational view of the toy gun as shown in FIG. 11.

Then, the pressurized air contained in the receiving space 611 of the sleeve 61 is ejected outward from the air nozzle 612 of the sleeve 61 to impact the plastic cartridge 781 so that the plastic cartridge 781 is ejected outward from the magazine 78 as shown in FIG. 11. Thus, when the trigger 63 is pressed successively, the above-mentioned procedures are repeated, so that the plastic cartridges 781 are ejected outward from the magazine 78 successively so as to perform the successive shooting of the toy gun.

After the trigger 63 is released, the motor stops operating, the side pin 544 of the third composite gear 54 is slidable by the pivoting inertia of the third composite gear 54 to rest on the hook portion 614 of the sleeve 61 as shown in FIG. 12.

Figure 13:
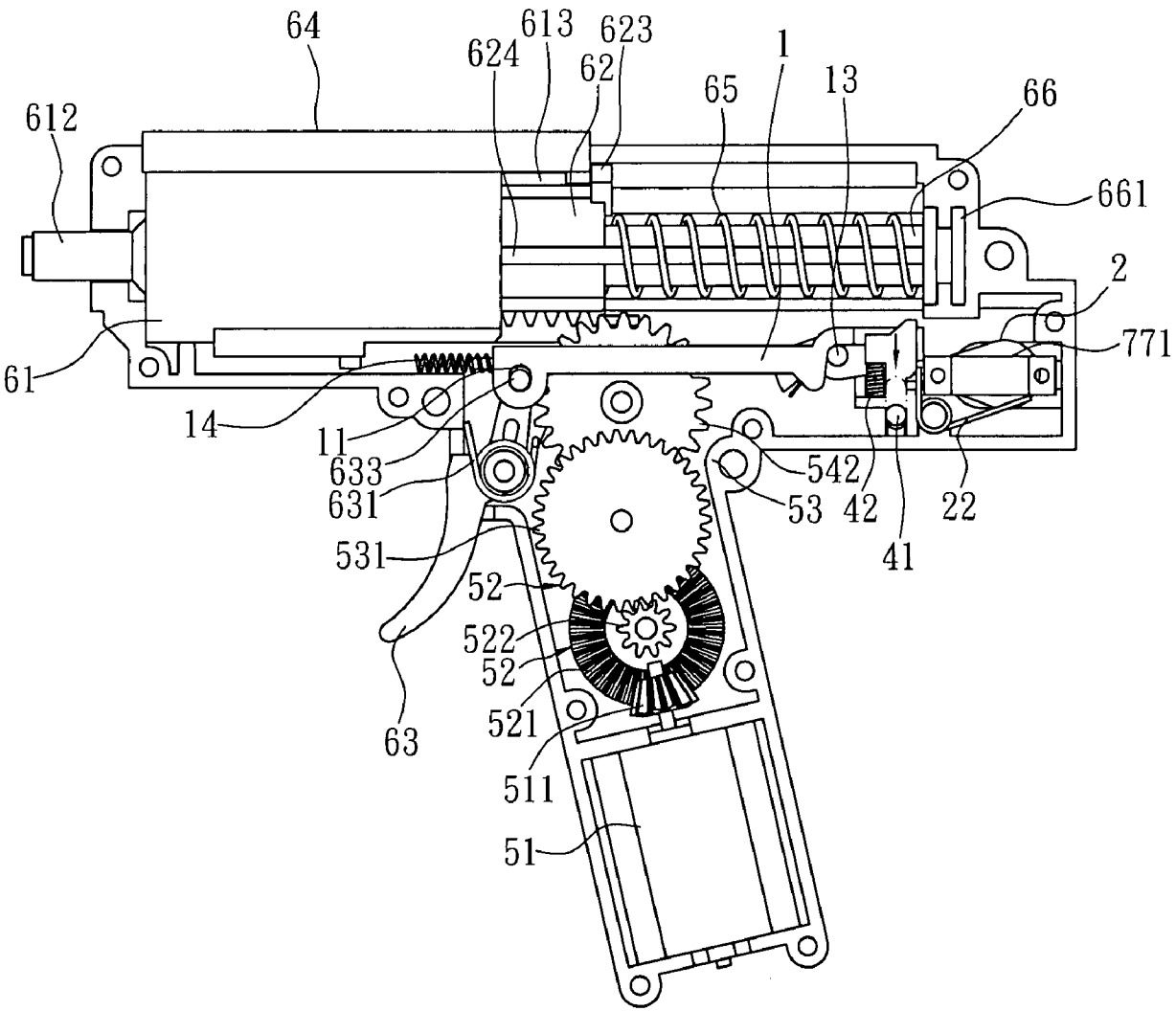
FIG. 13 is a schematic operational view of the toy gun as shown in FIG. 6.

As shown in FIG. 13, the toy gun is controlled in a manual manner. FIGS. 13–17 show the manual shooting of the toy gun.

In operation, the push knob 41 of the push block 4 is pushed downward in the control slot 76 of the housing 7 as shown in FIG. 13 to drive the push block 4 to push the driven member 2, thereby detaching the hook portion 21 of the driven member 2 from the hook portion 12 of the driven lever 1. Then, the pull member 64 is pulled by pulling the pull bar 641. At this time, the pull member 64 has an end portion rested on the catch 623 of the piston 62, so that the piston 62 is moved by the pull member 64 until the rack 625 of the piston 62 meshes with the second gear 541 of the third composite gear 54.

Figure 14:
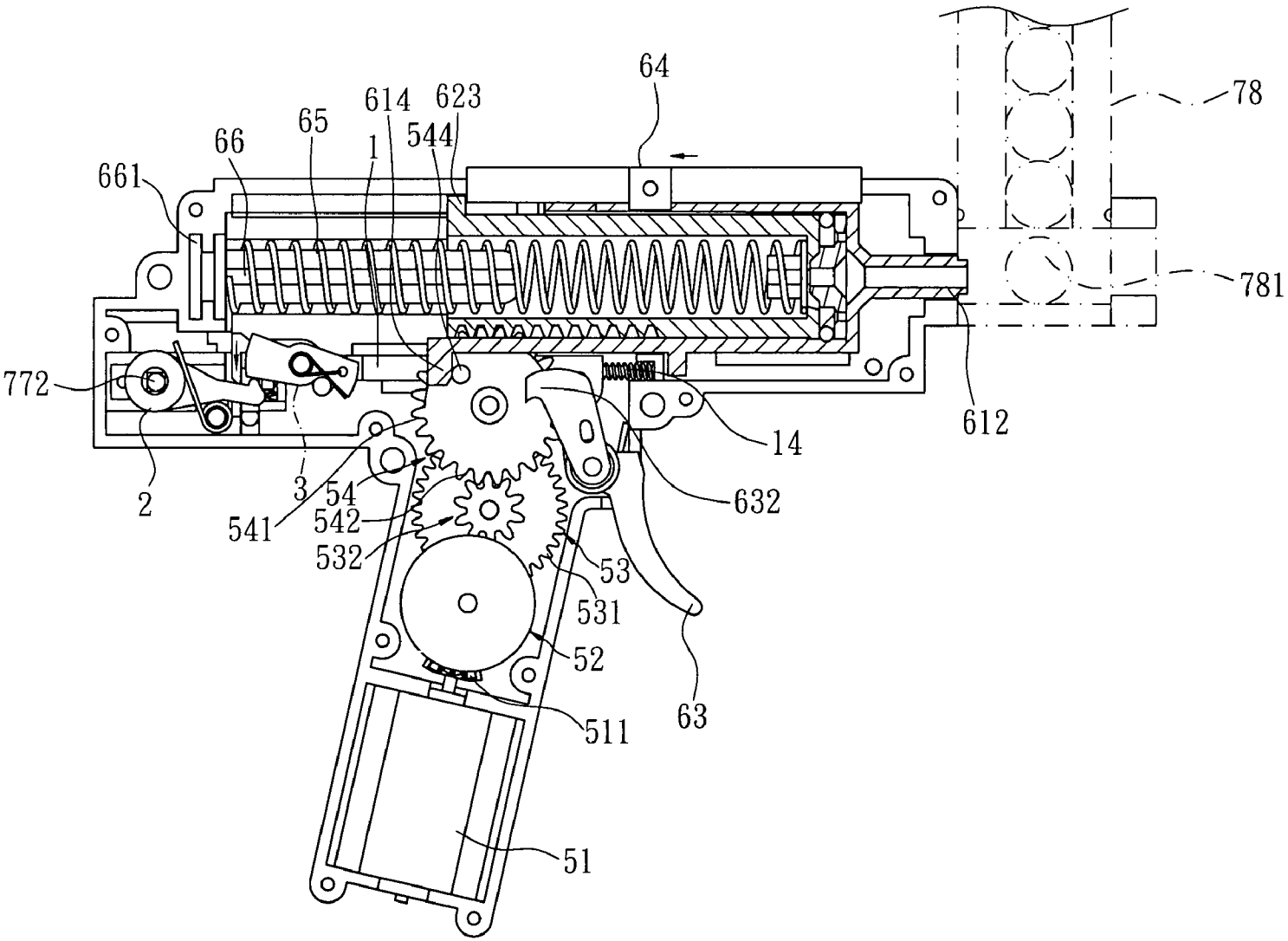
FIG. 14 is a side plan cross-sectional operational view of the toy gun as shown in FIG. 1.

When the rack 625 of the piston 62 meshes with the second gear 541 of the third composite gear 54, the third composite gear 54 is rotated to move the side pin 544 which pushes the hook portion 614 of the sleeve 61 to retract the air nozzle 612 of the sleeve 61 into the hollow portion 71 of the housing 7, so that the plastic cartridge 781 contained in the magazine 78 falls down to the position in front of the air nozzle 612 of the sleeve 61 as shown in FIG. 14. Then, the piston 62 is moved by the pull member 64 successively to compress the piston spring 65 successively.

Figure 3:
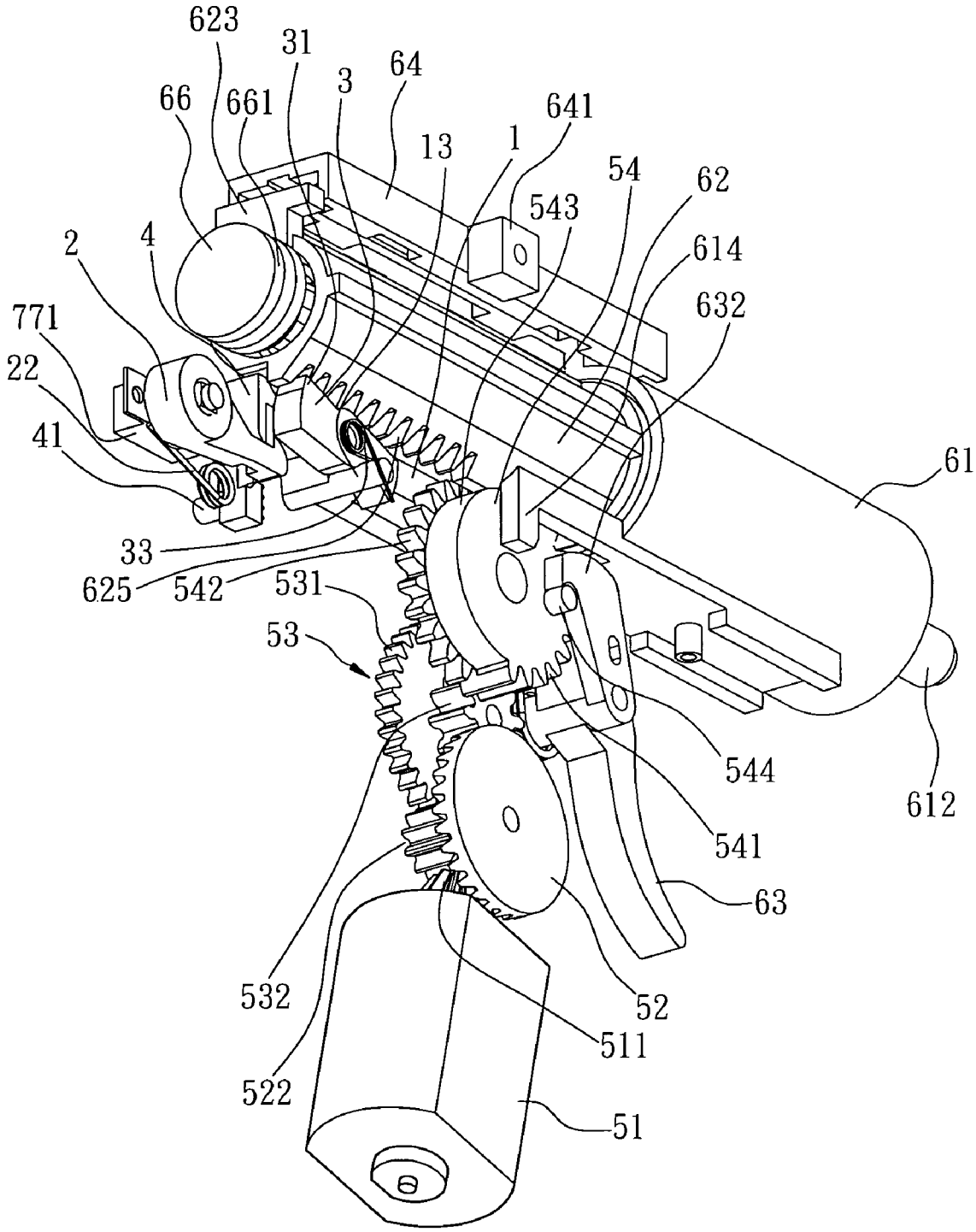
FIG. 3 is a partially perspective view of the toy gun as shown in FIG. 1.
Figure 4:
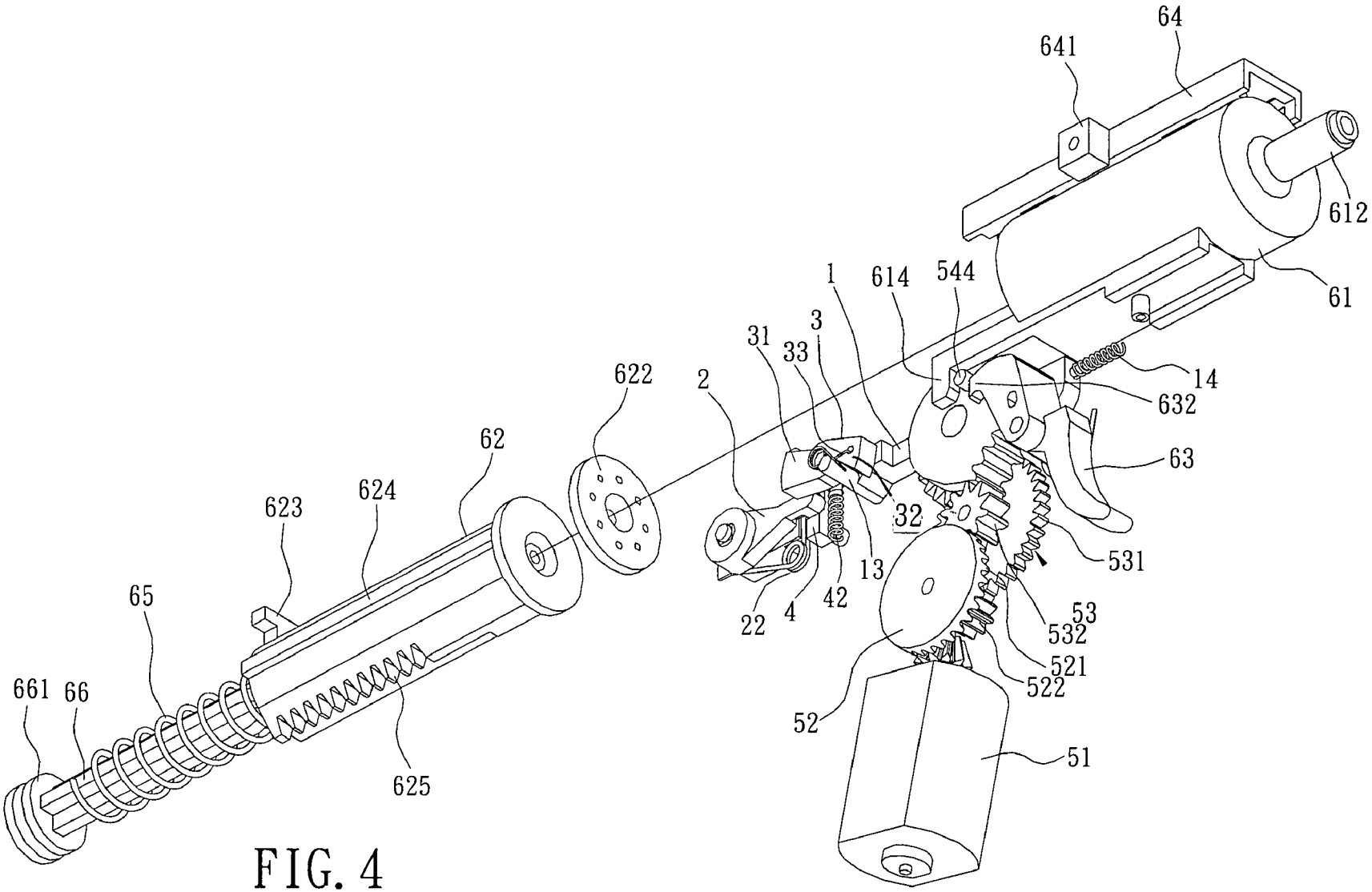
FIG. 4 is a partially exploded perspective view of the toy gun as shown in FIG. 1.
Figure 5:
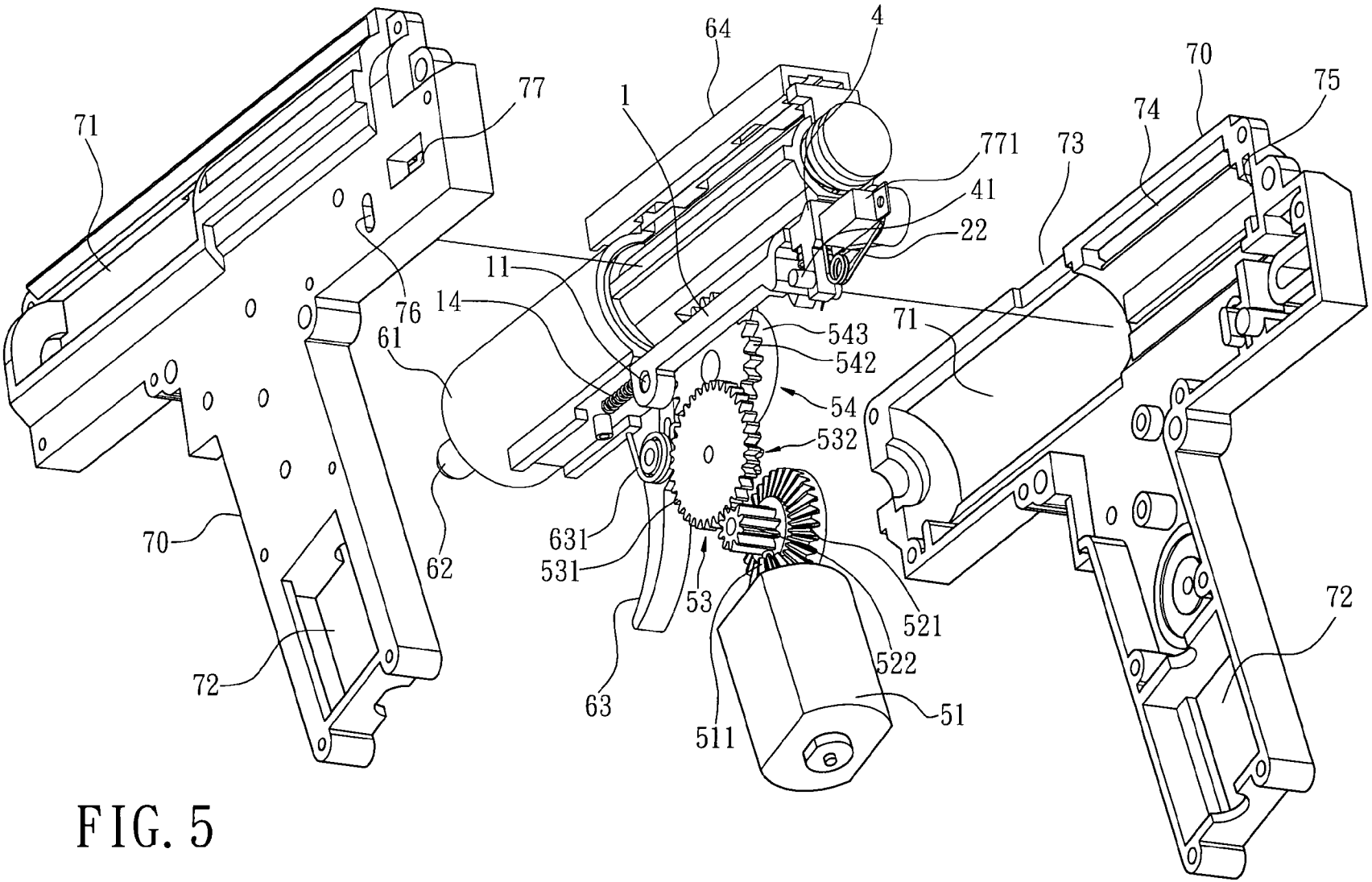
FIG. 5 is a partially exploded perspective view of the toy gun as shown in FIG. 1.
Figure 15:
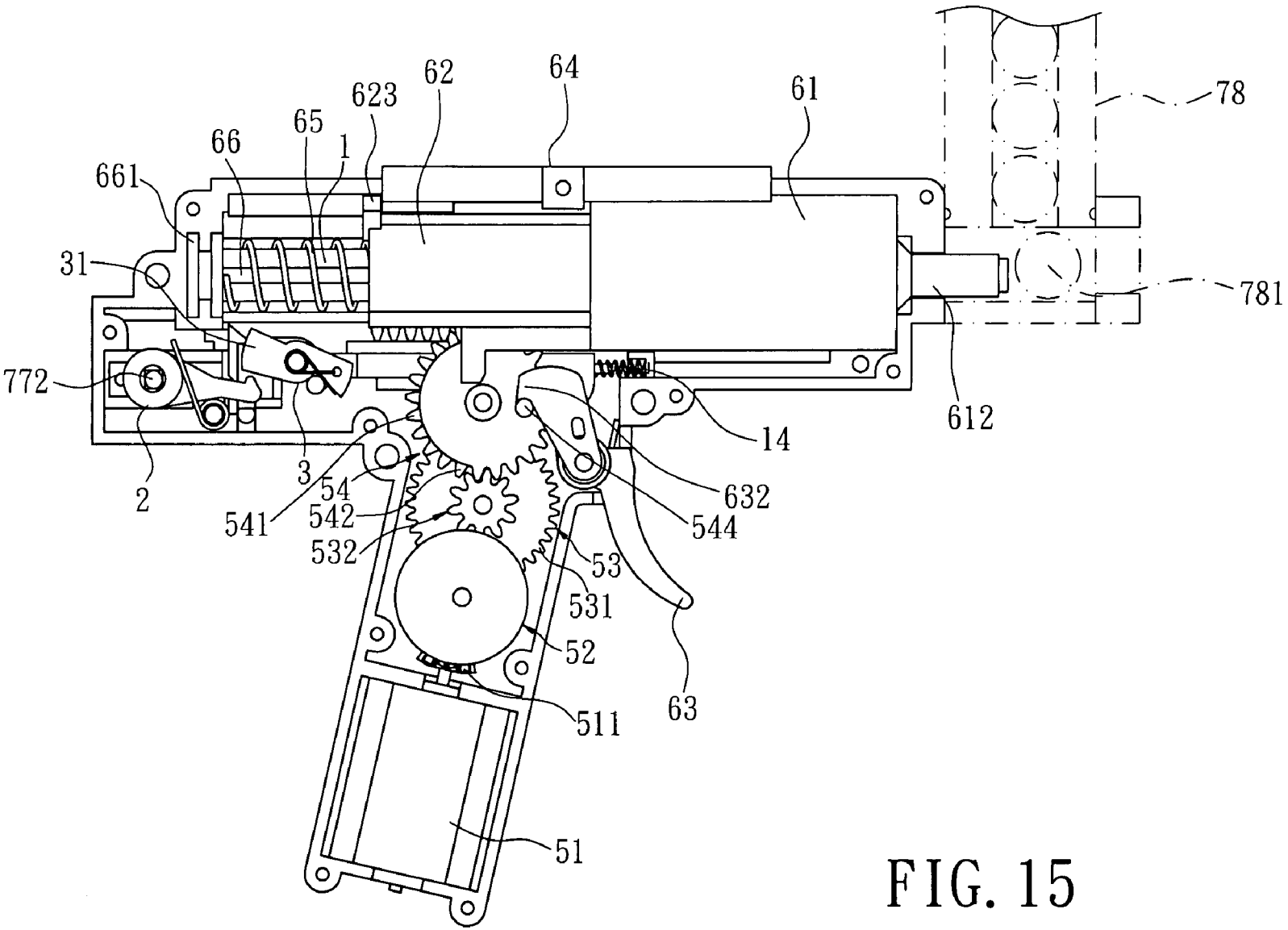
FIG. 15 is a schematic operational view of the toy gun as shown in FIG. 14.
Figure 16:
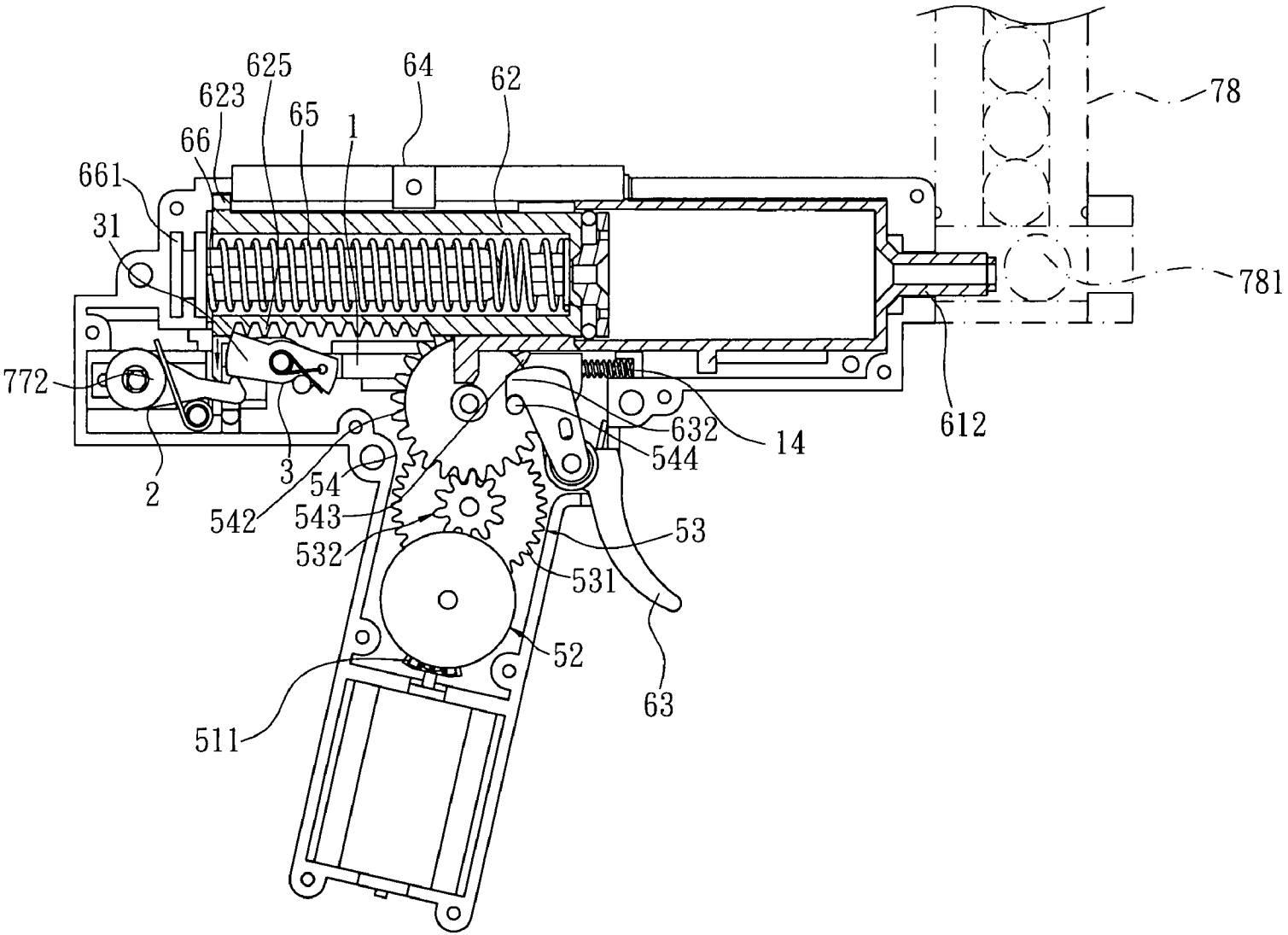
FIG. 16 is a schematic operational view of the toy gun as shown in FIG. 15.
Figure 17:
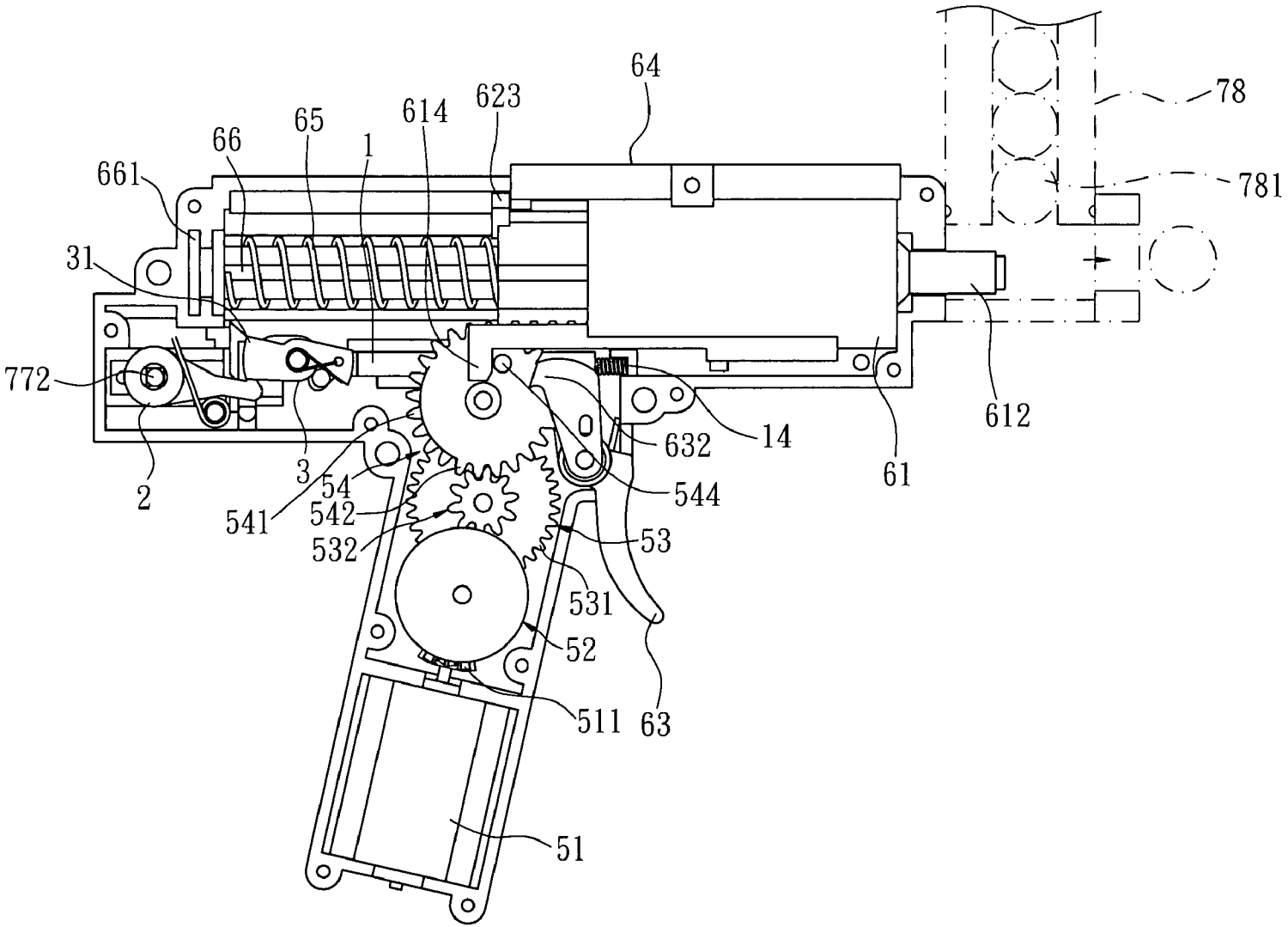
FIG. 17 is a schematic operational view of the toy gun as shown in FIG. 16.

When the piston 62 is moved to the limit position as shown in FIGS. 3, 15 and 16, the push portion 31 the pivot member 3 is engaged with an end portion of the rack 625 of the piston 62, and the side pin 544 of the third composite gear 54 is hooked by the hook portion 632 of the trigger 63. When the trigger 63 is pressed, the hook portion 632 of the trigger 63 is detached from the side pin 544 of the third composite gear 54. At this time, the side pin 633 of the trigger 63 is inserted into the insertion hole 11 of the driven lever 1, so that when the trigger 63 is pressed, the driven lever 1 is driven to move the side pin 13 which pushes the catch ramp 32 of the pivot member 3 to pivot the pivot member 3 which moves the push portion 31 to disengage from the rack 625 of the piston 62, thereby detaching the piston 62 from the pivot member 3, such that the piston 62 is rapidly pressed into the receiving space 611 of the sleeve 61 by the restoring force of the piston spring 65 to compress and pressurize the air contained in the receiving space 611 of the sleeve 61. Then, the pressurized air contained in the receiving space 611 of the sleeve 61 is ejected outward from the air nozzle 612 of the sleeve 61 to impact the plastic cartridge 781 so that the plastic cartridge 781 is ejected outward from the magazine 78 as shown in FIG. 17. Thus, the user has to pull the pull member 64 and to press the trigger 63 so as to shoot the plastic cartridges 781 individually in a manual manner.

Accordingly, the toy gun can shoot the plastic cartridges successively in an automatically controlled manner by the motor and the power switch and can shoot the plastic cartridges individually in a manual manner by pulling the pull member 64 and pressing the trigger, thereby enhancing the versatility of the toy gun, and thereby increasing the playing amusement of the toy gun.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A toy gun, comprising:

a housing;

a driven lever driven by a trigger to slide transversely, and having an end provided with a hook portion and a side pin located beside the hook portion;

a drive mechanism including a motor;

a driven member having a first end provided, with a hook portion hooked on the hook portion of the driven lever and a second end formed with a mounting hole mounted on a push button of a power switch so as to control an electric connection of the motor which drives the drive mechanism to drive a piston to move in a sleeve reciprocatingly, to compress and pressurize air contained in the sleeve to form a successive shooting controlled by the motor and the power switch;

a push block mounted on a mediate portion of the driven member in a perpendicular manner and having a side provided with a push knob which is protruded from the housing and movable to drive the push block to push the driven member to detach the hook portion of the driven member from the hook portion of the driven lever to interrupt the electric connection of the motor to stop the successive shooting controlled by the motor and the power switch;

a pivot member pivotally mounted in the housing and having a first end having a first side provided with a recessed catch ramp rested on the side pin of the driven lever and a second end having a second side provided with an oblique push portion engaged with a rack provided on a periphery of the piston.

2. The toy gun in accordance with claim 1, wherein the driven lever is driven manually to move the side pin which pushes the catch ramp of the pivot member to pivot the pivot member which moves the push portion to disengage from the rack of the piston, thereby detaching the piston from the pivot member, such that the piston is pressed into the sleeve by an elastic force of a piston spring to compress and pressurize the air contained in the sleeve to form an individual shooting controlled in a manual work.

3. The toy gun in accordance with claim 2, wherein the driven lever is driven by pressing the trigger so as to move the side pin of the driven lever.

4. The toy gun in accordance with claim 1, wherein the motor drives a first composite gear which drives a second composite gear which drives a third composite gear which has a first side formed with a first gear meshing with the second composite gear and a second side having a periphery formed with a partially extending second gear and a partially extending breach, the second gear of the third composite gear meshes with the rack of the piston.

5. The toy gun in accordance with claim 4, wherein the first gear of the third composite gear is driven and rotated to drive the second gear of the third composite gear to drive the rack of the piston to move the piston to compress a piston spring.

6. The toy gun in accordance with claim 5, wherein the third composite gear is driven to a position where the second gear of the third composite gear disengages from the rack of the piston and the breach of the third composite gear aligns with the rack of the piston, thereby detaching the piston from the third composite gear, so that the piston is pressed into the sleeve by the restoring force of the piston spring to compress and pressurize the air contained in the sleeve.

7. The toy gun in accordance with claim 4, wherein the third composite gear of the drive mechanism has a side pin protruding from the second side of the third composite gear, the trigger has an end portion provided with a hook portion extended into a movement path of the side pin of the third composite gear.

8. The toy gun in accordance with claim 7, wherein movement of the side pin of the third composite gear is stopped by the hook portion of the trigger.

9. The toy gun in accordance with claim 8, wherein the side pin of the third composite gear is detached from the hook portion of the trigger by pressing the trigger, so that the third composite gear is rotatable to drive the piston.

10. The toy gun in accordance with claim 4, wherein the sleeve has a periphery provided with an axially extending hook portion extended into a movement path of the side pin of the third composite gear.

11. The toy gun in accordance with claim 10, wherein the hook portion of the sleeve is substantially L-shaped.

12. The toy gun in accordance with claim 10, wherein the hook portion of the sleeve is driven by the side pin of the third composite gear.

13. The toy gun in accordance with claim 12, wherein the hook portion of the sleeve is movable between a first position where the hook portion of the sleeve is driven by the side pin of the third composite gear to drive the sleeve to move and retract through a determined distance and a second position where the hook portion of the sleeve is detached from the side pin of the third composite gear, so that the sleeve is returned by an elastic force of a piston spring.

14. The toy gun in accordance with claim 7, wherein the end portion of the trigger is provided with a side pin located beside the hook portion, and the driven lever has a second end formed with an insertion hole to allow insertion of the side pin of the trigger.

15. The toy gun in accordance with claim 1, further comprising a restoring spring biased between the driven lever and the housing so that the driven lever is slidable in the housing elastically.

16. The toy gun in accordance with claim 1, wherein the driven member is combined with a restoring spring to maintain a restoring effect.

17. The toy gun in accordance with claim 1, wherein the pivot member is combined with a restoring spring to maintain an elastic pivoting effect.

18. The toy gun in accordance with claim 1, wherein the housing is formed with a vertically extending control slot, and the push knob of the push block is extended through and protruded from the control slot of the housing.

19. The toy gun in accordance with claim 1, further comprising a restoring spring biased between the push block and the housing so that the push block is slidable in the housing elastically.

20. The toy gun in accordance with claim 1, wherein the housing is formed with a horizontally extending power switch chamber to receive the power switch.

* * * * *